US007008469B2

(12) United States Patent
Vetter et al.

(10) Patent No.: US 7,008,469 B2
(45) Date of Patent: Mar. 7, 2006

(54) PORTABLE AIR FILTRATION SYSTEM UTILIZING A CONDUCTIVE COATING AND A FILTER FOR USE THEREIN

(75) Inventors: Stephan Michael Vetter, Lockport, NY (US); Donald John Enzinna, Lockport, NY (US)

(73) Assignee: Delphi Technologies, Inc., Troy, MI (US)

( * ) Notice: Subject to any disclaimer, the term of this patent is extended or adjusted under 35 U.S.C. 154(b) by 150 days.

(21) Appl. No.: 10/647,482

(22) Filed: Aug. 25, 2003

(65) Prior Publication Data

US 2005/0045036 A1 Mar. 3, 2005

(51) Int. Cl.
*B03C 3/155* (2006.01)

(52) U.S. Cl. ..... 96/67; 96/69

(58) Field of Classification Search ..... 96/67, 96/69, 77, 97, 98; 95/59, 79; 55/DIG. 39
See application file for complete search history.

(56) References Cited

U.S. PATENT DOCUMENTS

| | | | | | |
|---|---|---|---|---|---|
| 4,244,710 | A | | 1/1981 | Burger | 95/69 |
| 4,357,151 | A | | 11/1982 | Helfritch et al. | 95/68 |
| 4,509,958 | A | * | 4/1985 | Masuda et al. | 96/60 |
| 4,750,921 | A | * | 6/1988 | Sugita et al. | 96/67 |
| 4,768,423 | A | | 9/1988 | Boeger | 454/146 |
| 4,940,470 | A | | 7/1990 | Jaisinghani et al. | 95/78 |
| 5,133,788 | A | * | 7/1992 | Backus | 55/467 |
| 5,268,009 | A | | 12/1993 | Thompson et al. | 96/67 |
| 5,403,383 | A | | 4/1995 | Jaisinghani | 95/69 |
| 5,433,772 | A | | 7/1995 | Sikora | 96/87 |
| 5,474,600 | A | * | 12/1995 | Volodina et al. | 96/57 |
| 5,549,735 | A | | 8/1996 | Coppom | 96/63 |
| 5,948,355 | A | | 9/1999 | Fujishima et al. | 422/4 |
| 5,980,614 | A | * | 11/1999 | Loreth et al. | 96/63 |
| 6,077,334 | A | * | 6/2000 | Joannou | 96/66 |
| 6,126,727 | A | * | 10/2000 | Lo | 96/39 |
| 6,183,200 | B1 | * | 2/2001 | Chang | 416/146 R |
| 6,391,093 | B1 | | 5/2002 | French et al. | 95/226 |
| 6,491,743 | B1 | * | 12/2002 | Joannou et al. | 96/67 |
| 6,497,754 | B1 | * | 12/2002 | Joannou | 96/67 |
| 6,527,834 | B1 | * | 3/2003 | Jörder et al. | 96/68 |
| 6,790,259 | B1 | * | 9/2004 | Rittri et al. | 95/78 |

* cited by examiner

*Primary Examiner*—Richard L. Chiesa
(74) *Attorney, Agent, or Firm*—Patrick M. Griffin

(57) ABSTRACT

A portable air filtration system includes a filter housing having an air inlet and outlet. The housing defines a filtration chamber between the inlet and outlet. The air filtration system uses an intake fan, an ionizing mechanism, a filter media, and a conductive coating to filter air. The fan moves the air through the chamber. The ionizing mechanism ionizes particles within the air to a negative charge. The media includes an upstream side facing the inlet and a downstream side facing the outlet and is disposed between the ionizing mechanism and the outlet to entrap the particles. The conductive coating is applied to the upstream side of the media. This establishes an electric field between the ionizing mechanism and the conductive coating. Furthermore, the upstream side of the media is electrically-connected to ground through the conductive coating for dissipating the negative charge of the particles entrapped within the media.

31 Claims, 9 Drawing Sheets

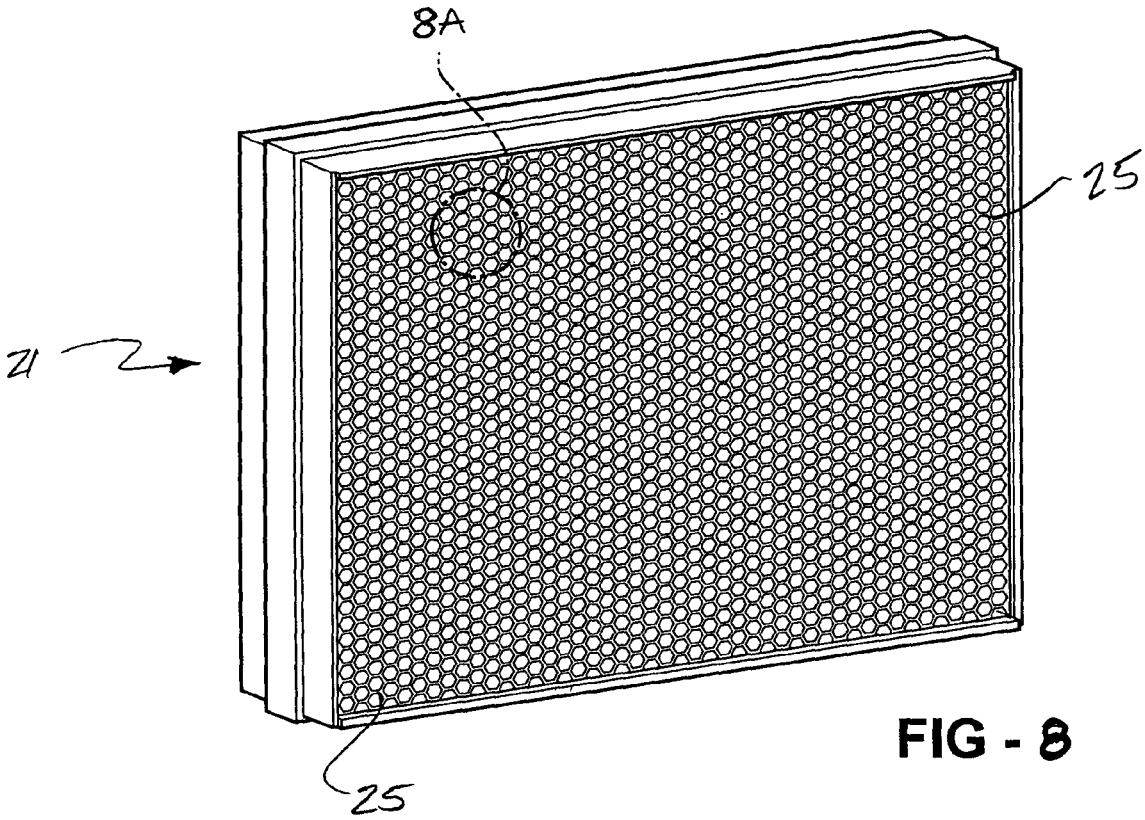
FIG - 8
FIG - 8A
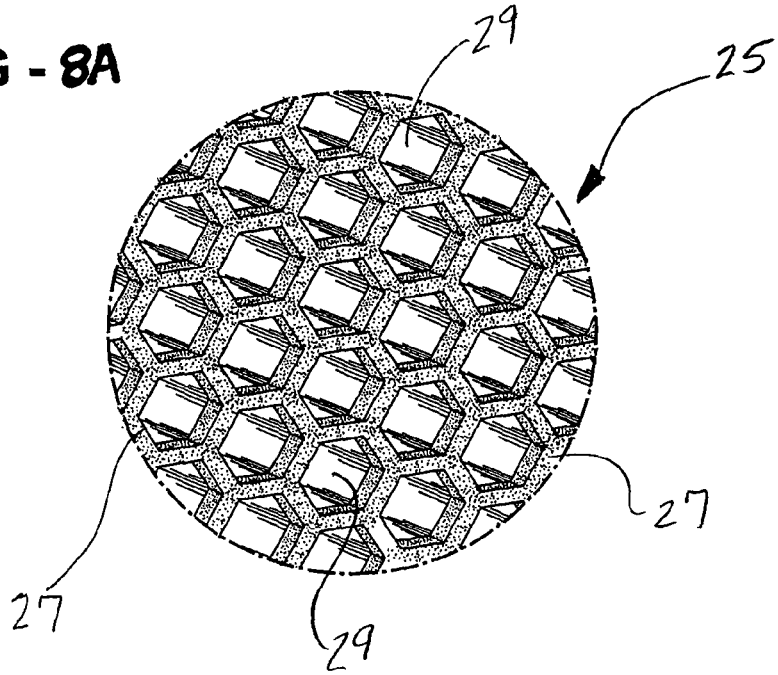

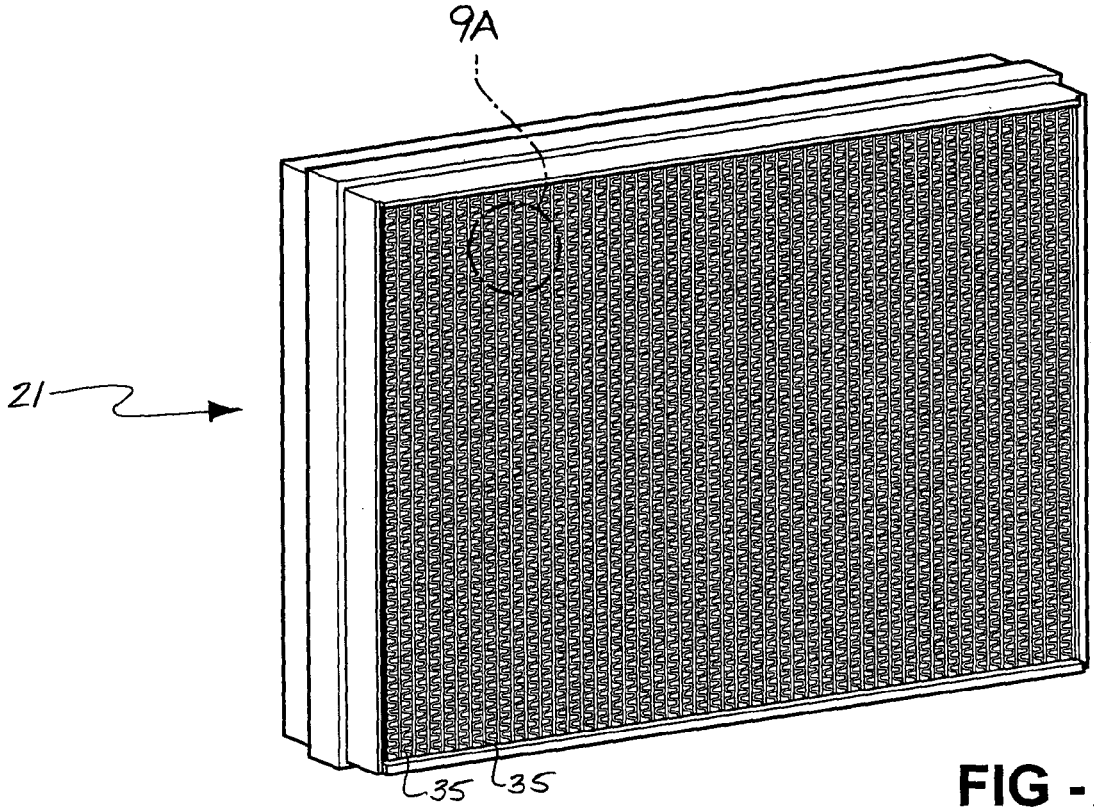
FIG - 9
FIG - 9A
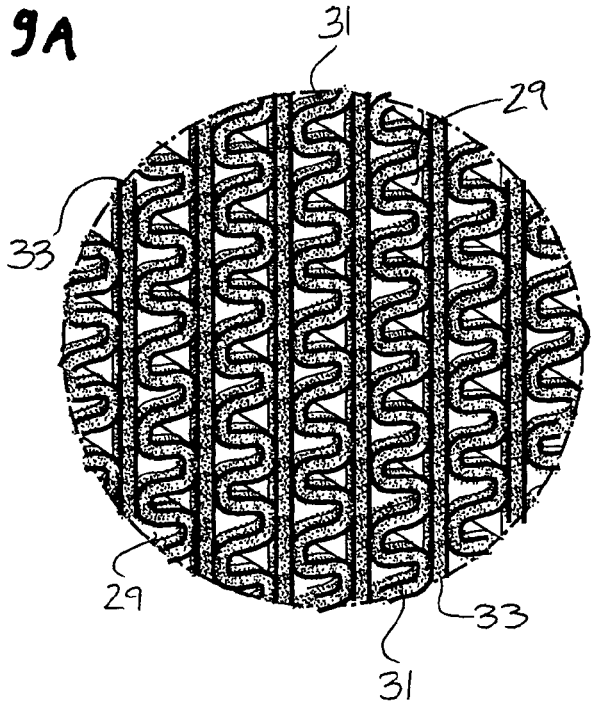

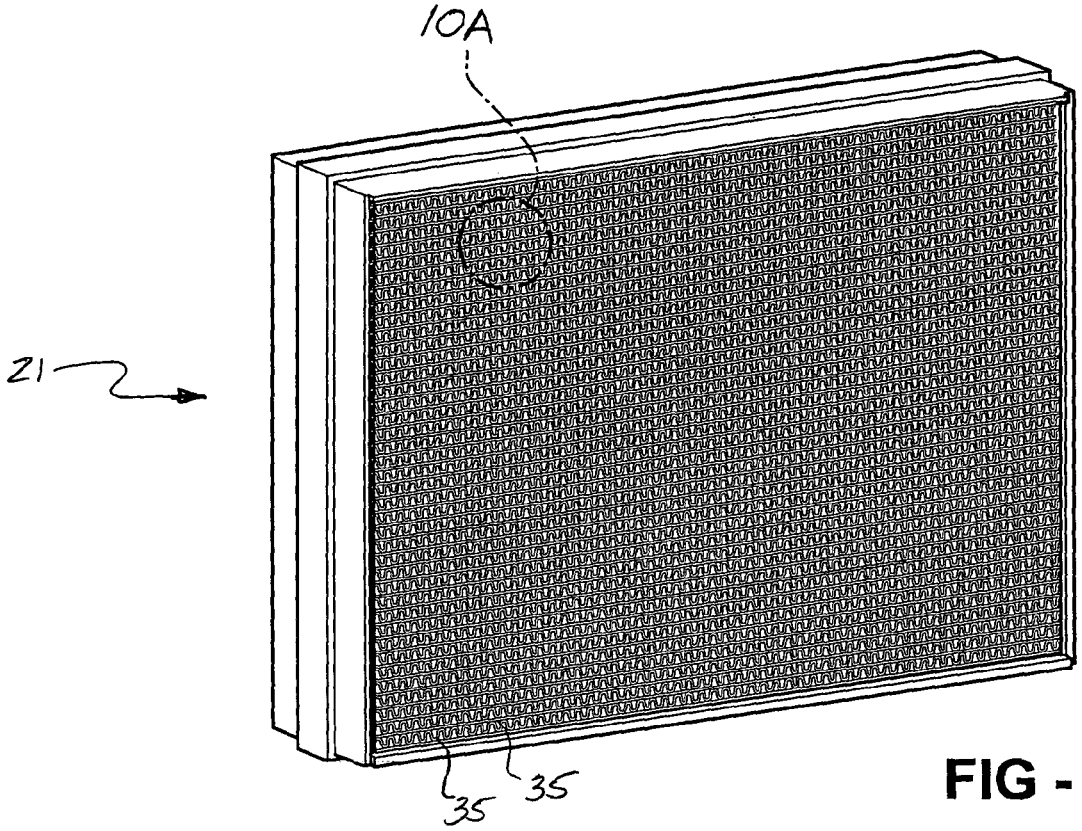
FIG - 10
FIG - 10A
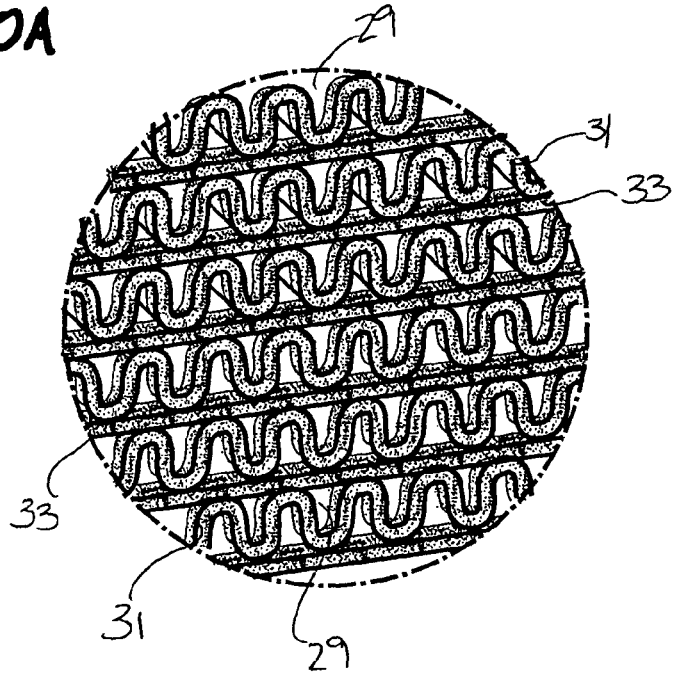

PORTABLE AIR FILTRATION SYSTEM UTILIZING A CONDUCTIVE COATING AND A FILTER FOR USE THEREIN

RELATED APPLICATIONS

This application is related to co-pending U.S. patent application Ser. No. 10/647,748 entitled "Portable Air Filtration System" which is commonly assigned and was filed on the same date as the present application. Each application is directed to a different invention.

TECHNICAL FIELD

The subject invention generally relates to a portable air filtration system for filtering air. More specifically, the subject invention relates to a portable air filtration system that utilizes a conductive coating to dissipate a charge of particles entrapped within a filter media. The portable air filtration system of the subject invention is primarily for use in vehicles but may also be used to filter air in rooms of commercial and residential buildings.

BACKGROUND OF THE INVENTION

Air filtration systems are known in the art. Many of these air filtration systems utilize ionization to enhance efficiency of a filter used within the air filtration system. The air filtration systems of the prior art are deficient for a variety of reasons.

One example of a prior art air filtration system is disclosed in U.S. Pat. No. 4,940,470 to Jaisinghani et al. With particular reference to FIG. 1 of the '470 patent, this air filtration system is deficient because the electrode E, a ground electrode, is positioned downstream from the filter F. As such, the entire filter F is disposed within the electric field that is established between the ionizing wires W and the electrode E. Ultimately, this particular air filtration system presents a safety hazard as the filter F may be exposed to arcing that occurs in the electric field. The filter F may catch fire, destroy the air filtration system, and be dangerous to users of the air filtration system.

A further example of a prior art air filtration system is disclosed in U.S. Pat. No. 5,403,383 also to Jaisinghani et al. With particular reference to FIG. 1 of the '383 patent, this air filtration system is deficient for the same reason identified above with respect to the '470 patent. That is, the ground electrode 106 is positioned downstream from the filter 114 such that the entire filter 114 is disposed within the electric field that is established between the ionizing wires 110 and the ground electrode 106. This position of the ground electrode 106 presents the same safety issues described above, i.e., exposure of the filter 114 to arcing in the electric field. However, the air filtration system disclosed in the '383 patent is also deficient because it requires two electrodes that are separate from one another, a control electrode 104 and a downstream ground electrode 106, for sufficient ionization. The requirement for this additional componentry is unnecessary. Therefore, the design for this air filtration system is not optimized and is unnecessarily expensive.

The air filtration systems of the prior art are also deficient in that they do not make use of conductive coatings that can be applied, or otherwise electrically-connected to, the filter such that the conductive coating can function as the electrode to establish the electric field and to dissipate a charge of the particles. Such conductive coatings enable maximum efficiency of the filter. Finally, many of the air filtration systems of the prior art are deficient in that they are not sufficiently portable. That is, many air filtration systems are heavy, bulky, and awkward. For example, many air filtration systems do not include a handle for conveniently carrying the air filtration system from vehicle to vehicle or from room to room.

Due to the various deficiencies associated with the air filtration systems of the prior art, including those described above, it is desirable to provide a novel air filtration system that is safe, portable, has simplified componentry and that strategically makes use of a conductive coating while still achieving enhanced filtration of particles from air.

SUMMARY OF THE INVENTION

A portable air filtration system for filtering air is disclosed. The air filtration system includes a filter housing, an intake fan, an ionizing mechanism, a filter media, and a conductive coating. More specifically, the filter housing includes an air inlet and an air outlet and defines a filtration chamber between the air inlet and the air outlet. The intake fan is disposed within the filter housing to move the air through the filtration chamber by drawing the air in through the air inlet and dispelling the air out through the air outlet. The ionizing mechanism, which is disposed between the intake fan and the air outlet, ionizes particles within the air to a negative charge. The filter media has an upstream side that faces the air inlet and a downstream side that faces the air outlet. Further, the filter media is disposed between the ionizing mechanism and the air outlet for entrapping the particles between the upstream side and the downstream side.

The conductive coating is applied to the upstream side of the filter media. As a result, an electric field is established between the ionizing mechanism and the conductive coating such that the entire filter media is not within the electric field. In addition, the upstream side of the filter media is electrically-connected to ground through the conductive coating. The negative charge of the particles that are entrapped within the filter media is dissipated through the conductive coating.

A filter for use in the portable air filtration system is also disclosed. This filter is made up of the filter media and the conductive coating. More specifically, as described above, the filter media entraps the particles in the air and the conductive coating is applied to the filter media for dissipating a charge of the particles entrapped within the filter media.

Accordingly, the subject invention provides a novel air filtration system that is safe. More specifically, because the entire filter media is not within the electric field, the filter media is not exposed to substantial arcing within the electric field and is not susceptible to catching fire. Furthermore, the air filtration system of the subject invention eliminates the need for a separate control electrode and ground electrode. Instead, this air filtration system simplifies the required componentry by strategically integrating the functions of the control electrode and the ground electrode into the conductive coating, which functions as a single electrode. The conductive coating provides a plane for establishing the electric field with the ionizing mechanism and also provides a ground for dissipating charges in the filter media. It is also advantageous that the air filtration system of the subject invention is portable.

BRIEF DESCRIPTION OF THE DRAWINGS

Other advantages of the present invention will be readily appreciated as the same becomes better understood by reference to the following detailed description when considered in connection with the accompanying drawings wherein:

FIG. 8 is a perspective view of a filter for use in the portable air filtration system, wherein the filter includes non-woven, honeycomb filter media;

FIG. 8A is an enlarged perspective view of the filter in FIG. 8 illustrating the conductive coating applied to substantially hexagonal edges of the non-woven, honeycomb filter media at an upstream side;

FIG. 9 is a perspective view of a filter for use in the portable air filtration system, wherein the filter includes corrugated filter material interleaved between flat sheets that extend in a first orientation within the filter;

FIG. 9A is an enlarged perspective view of the filter in FIG. 9 illustrating the conductive coating applied to edges of the filter material and the flat sheets at the upstream side;

FIG. 10 is a perspective view of a filter for use in the portable air filtration system, wherein the filter includes corrugated filter material interleaved between flat sheets that extend in a second orientation within the filter; and FIG. 10A is an enlarged perspective view of the filter in FIG. 10 illustrating the conductive coating applied to edges of the filter material and the flat sheets at the upstream side.

DESCRIPTION OF THE PREFERRED EMBODIMENT

Referring to the Figures, wherein like numerals indicate like or corresponding parts throughout the several views, a portable air filtration system is generally disclosed at 10. For descriptive purposes only, the portable air filtration system 10 of the subject invention is hereinafter referred to as the filtration system 10.

Preferably, the filtration system 10 is used to filter air in a vehicle. In such an embodiment, the filtration system 10 can be placed on a floor, on a seat, or on any other suitable surface within the vehicle. As such, the filtration system 10 can be adapted to be secured on the surface by a standard safety restraint system, i.e., a seatbelt. However, the filtration system 10 of the subject invention may also be used to filter air in rooms of commercial and residential buildings.

Although not required, it is most preferred that the filtration system 10 include a handle 12 that is integrated into the filter housing 14. The handle 12 enhances the portability of the filtration system 10. As such, the filtration system 10 is mobile and can be conveniently moved from vehicle to vehicle or from room to room. As disclosed in FIG. 3, the handle 12 can be integrated into a filter housing 14 simply by being a recess within the filter housing 14 that can be accessed by a hand. Alternatively, although not disclosed in the Figures, the handle 12 can be integrated into the filter housing 14 by extending, either in a fixed manner or in a pivotable manner, from the filter housing 14.

Figure 3:
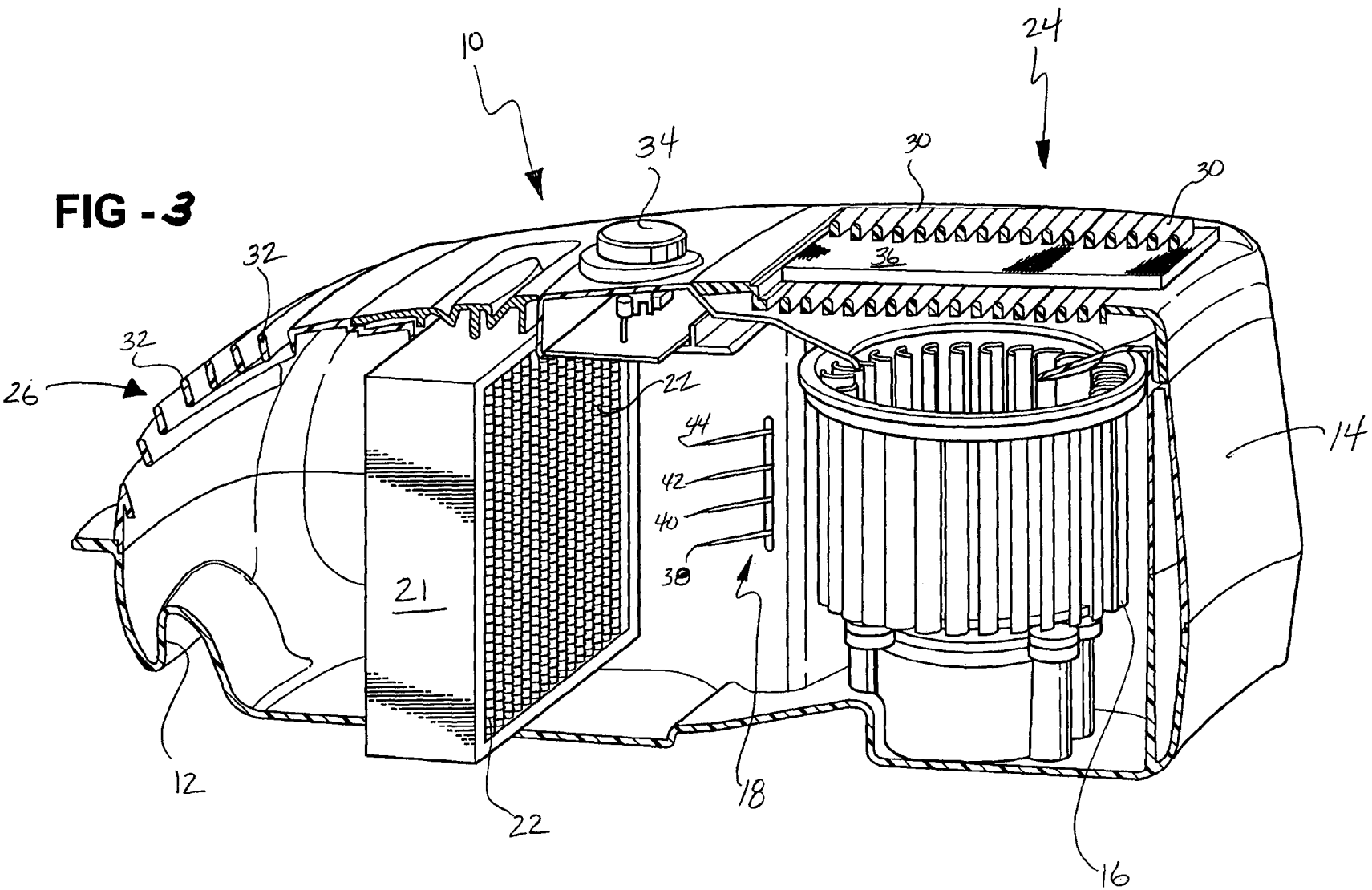
FIG. 3 is a partially cross-sectional perspective view of the portable air filtration system.
Figure 4:
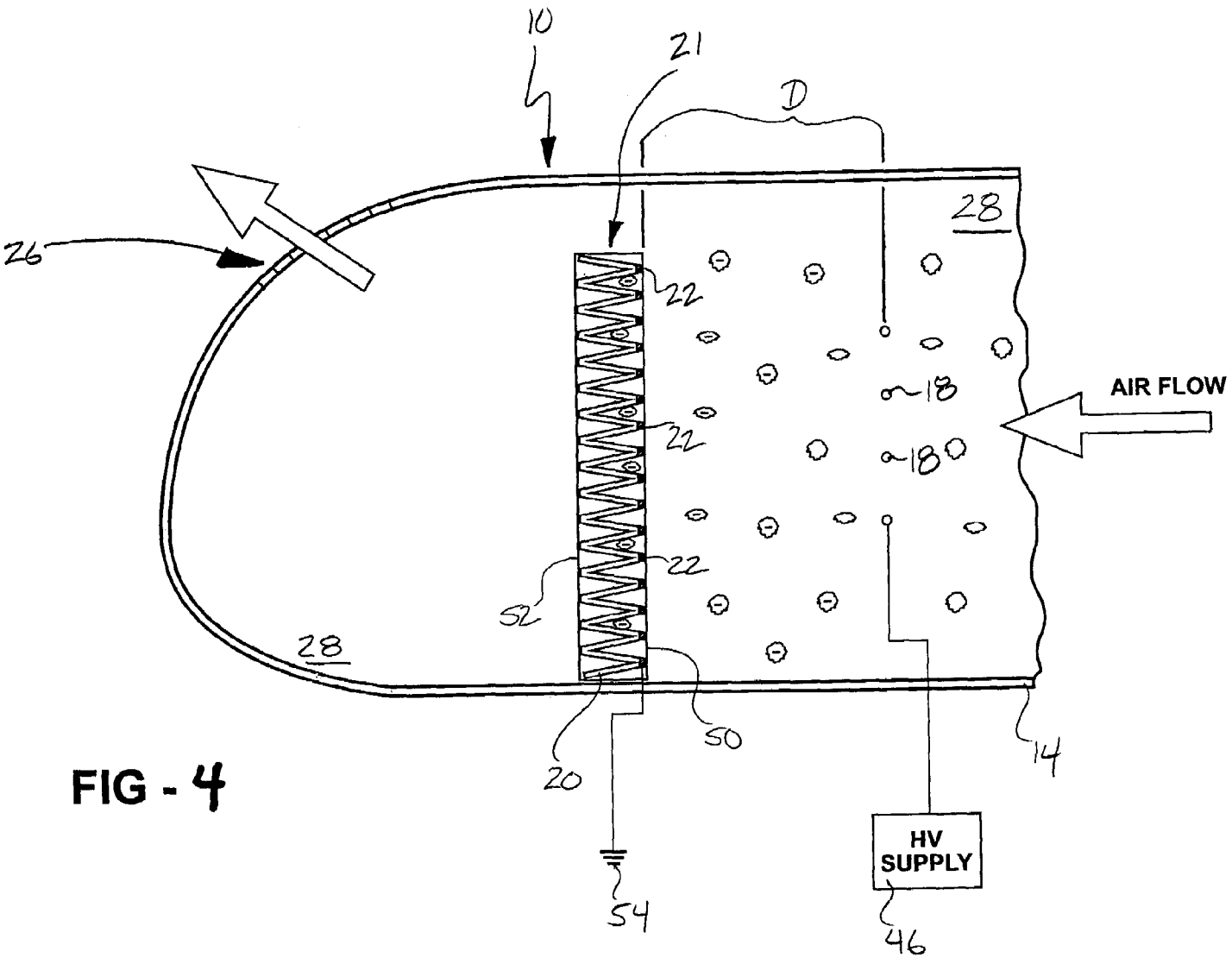
FIG. 4 is a schematic representation of the portable air filtration system illustrating flow of air across an ionizing mechanism, an electric field, a conductive coating, and a filter media.

Referring particularly to FIGS. 3 and 4, the filtration system 10 includes a filter housing 14, an intake fan 16, an ionizing mechanism 18, a filter media 20, and a conductive coating 22. The filter media 20 and the conductive coating 22 make up a filter 21 for use in the filtration system. Each of these components is described additionally below.

The filter housing 14 includes an air inlet 24 and an air outlet 26. The filter housing 14 also defines a filtration chamber 28 between the air inlet 24 and the air outlet 26. As schematically represented in FIG. 4, the air flows through the filtration chamber 28 where particles which are typically present in the air, such as dust, lint, pollen, allergens, and the like, are filtered. It is preferred that the filter housing 14 is plastic. That is, it is preferred that the filter housing 14 is made from a non-metal material that is either a thermoplastic or thermosetting polymeric material. To further enhance the transportability of the filtration system 10, the filtration system 10 is compact with the filter housing 14 having approximate dimensions of 390×190×170 mm. These dimensions can vary. However, the filtration system 10 of the subject invention provides a high level of clear air delivery rate (CADR) for such a compact unit.

Figure 1:
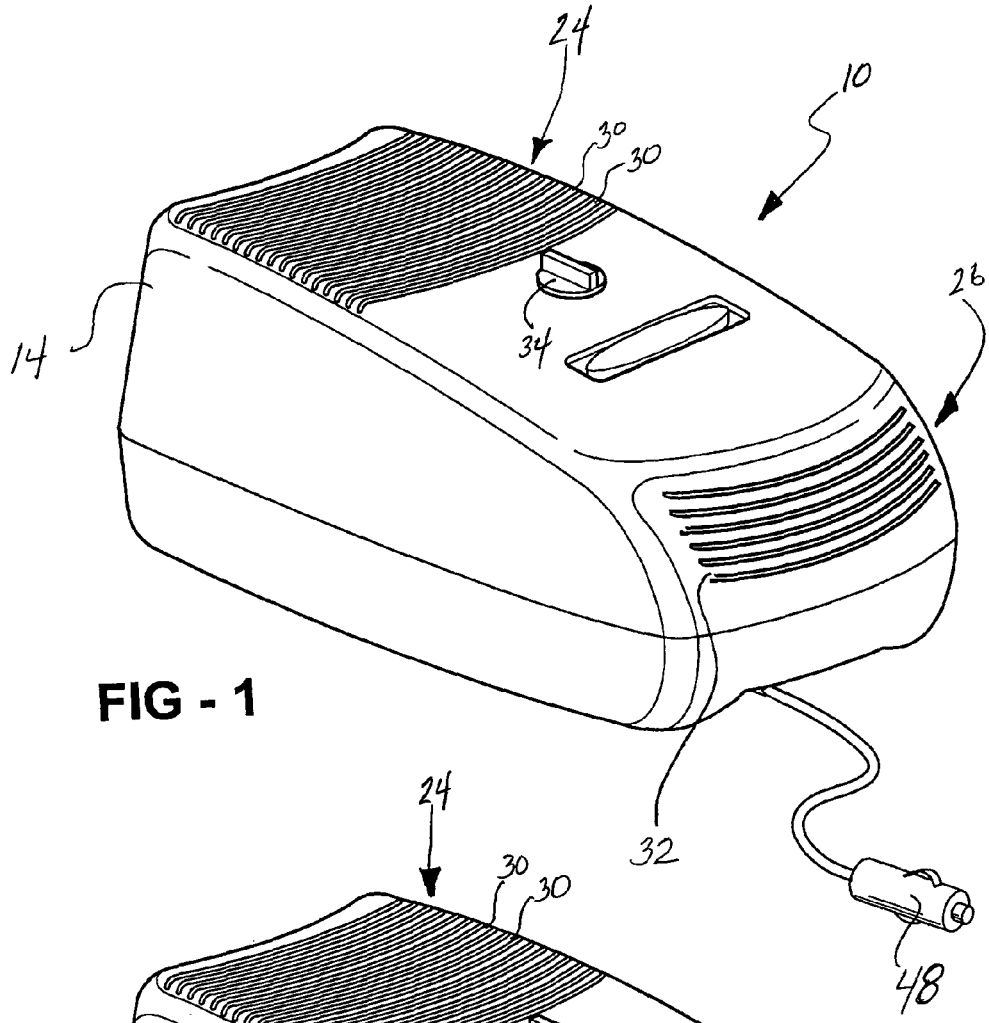
FIG. 1 is a perspective view of a portable air filtration system of the subject invention.

Referring to one preferred embodiment disclosed in FIG. 1, the air inlet 24 is further defined as inlet louvers 30 and the air outlet 26 is further defined as outlet louvers 32. Both the inlet louvers 30 and the outlet louvers 32 are defined within the filter housing 14.

Figure 2:
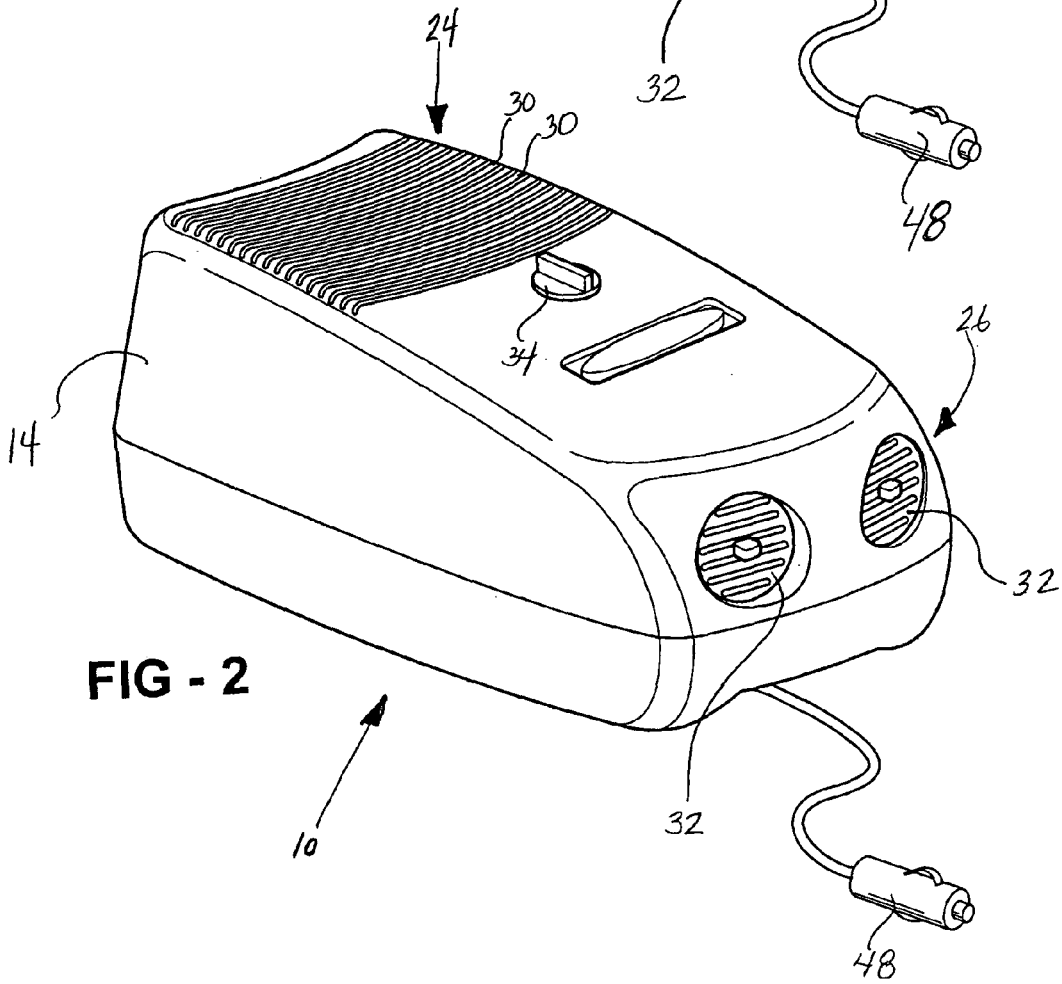
FIG. 2 is a perspective view of an alternative embodiment of the portable air filtration system illustrating adjustable louvers as an air outlet.

Referring to the most preferred embodiment of the subject invention, as disclosed in FIG. 2, at least one of the inlet louvers 30 and the outlet louvers 32 are adjustable. With the filtration system 10 disclosed in FIG. 2, only the outlet louvers 32 are adjustable. Although it is not disclosed in the Figures, it is possible for the inlet louvers 30 to be adjustable also.

The controllability, i.e., the ability to manipulate an angle, of the outlet louvers 32, is important so air exhausted out from the filtration system 10 can be targeted at a level where most occupants of a vehicle inhale and exhale. It is estimated that this level is achieved by angling the outlet louvers 32 approximately 60° upward, assuming the filtration system 10 is positioned on the seat of the vehicle. The range of angle for the outlet louvers 32 is typically 60° to 90°.

Referring to FIG. 3, the intake fan 16 is disposed within the filter housing 14. The intake fan 16 moves the air through the filtration chamber 28 by drawing the air in through the air inlet 24 and dispelling the air out through the air outlet 26. Preferably, the intake fan 16 is a centrifugal fan. It is also preferred that a speed of the intake fan 16 can be controlled such that users of the filtration system 10 can select a desired amount of filtering with a desired amount of noise level. As such, it is preferred that the filtration system 10 include an adjustment knob 34 that can be adjusted from low to high to control the speed of the intake fan 16. Clearly, increasing the speed of the intake fan 16 draws more air in through the air inlet 24 to be filtered but produces more noise, and vice versa.

Furthermore, although it is not required, the filtration system 10 preferably incorporates a pre-filter 36 between the air inlet 24 and the intake fan 16. The pre-filter 36, typically an activated carbon pre-filter, is primarily used to absorb odors present in the air as the air is drawn in through the air inlet 24.

The ionizing mechanism 18 is disposed between the intake fan 16 and the air outlet 26. In this position, the ionizing mechanism 18 ionizes the particles within the air to a negative charge, i.e. a negative state. Preferably, the ionizing mechanism 18 is further defined as a plurality of ionizing needles. More specifically, in the most preferred embodiment of the subject invention as disclosed in FIG. 3, the plurality of ionizing needles is further defined as a first 38, second 40, third 42, and fourth 44 ionizing needle. Any suitable number of ionizing needles can be utilized without varying the scope of the subject invention.

The filtration system 10 includes a high voltage power supply 46. The high voltage power supply 46 of the filtration system 10 is electrically-connected to the ionizing mechanism 18 and is electrically-connected to an energy source of the vehicle. For example, as disclosed in FIGS. 1 and 2, the filtration system 10 includes an adapter 48. The adapter 48 extends from the high voltage power supply 46. This adapter 48 is designed to insert into a cigarette lighter, or other port, in the vehicle and to tap into the energy source, such as a 12V battery, of the vehicle. It is preferred that the filtration system 10 also includes a circuit that incorporates a unique shut-off feature to protect a charge of the battery of the vehicle. There is also a DC-DC power converter incorporated into the circuit for supplying power to the filtration system 10. If the filtration system 10 of the subject invention is to be used in the rooms of commercial and residential buildings, then the high voltage power supply 46 of the filtration system 10 is operatively connected to an electrical system of the building, and a different adapter is utilized to plug into an electrical outlet.

To effectively ionize the particles within the air, the high voltage power supply 46 supplies a high voltage, approximately −15 kV, to the ionizing mechanism 18. However, this high voltage is at a very low amperage, less than 1 milliamp, such that less than 10 W of power is required overall.

The filter media 20 is disposed between the ionizing mechanism 18 and the air outlet 26. Ultimately, the filter media 20 entraps the particles yet allows the air to pass through the filtration system 10. As described additionally below, it is most preferred that the filter media 20 is an electrically-enhanced filter (EEF) media and preferably can be removed from the filter housing 14 for replacement purposes over time. With particular reference to the Figures, the filter media 20 includes an upstream side 50 facing the air inlet 24 and a downstream side 52 facing the air outlet 26. The particles are entrapped between the upstream side 50 and the downstream side 52.

Several different filter media 20 are suitable for use in the filtration system 10 of the subject invention including, but not limited to, woven filter media, non-woven filter media, cellular filter media, pleated filter media, non-pleated filter media, electret filter media, and combinations thereof. In the most preferred embodiment of the subject invention, the filter media 20 is the electret filter media. As understood by those skilled in the art, an electret filter media automatically has improved efficiency because such a filter media 20 already includes electrostatically charged fibers that can more effectively entrap the particles due to the establishment of a permanent state of polarization.

The conductive coating 22 is applied to the upstream side 50 of the filter media 20 to establish an electric field between the ionizing mechanism 18 and the conductive coating 22. Therefore, the electric field that is established is adjacent to the filter media 20. That is, the entire filter media 20 is not actually within the electric field. As such, the particles within the air are ionized upstream of the filter media 20 and no fire and/or other safety hazard is present with the filtration system 10 of the subject invention.

Figure 5:
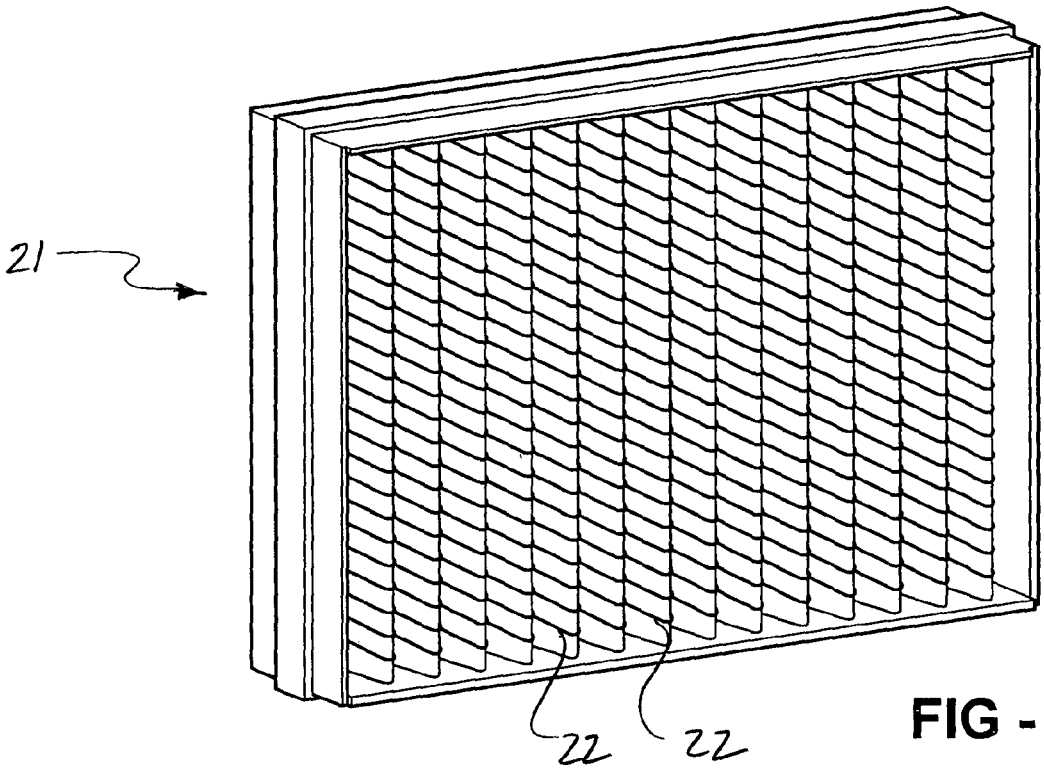
FIG. 5 is a perspective view of a filter for use in the portable air filtration system, wherein the filter includes the filter media and the conductive coating in a continuous pattern that is a perpendicular pattern of the conductive coating.
Figure 6:
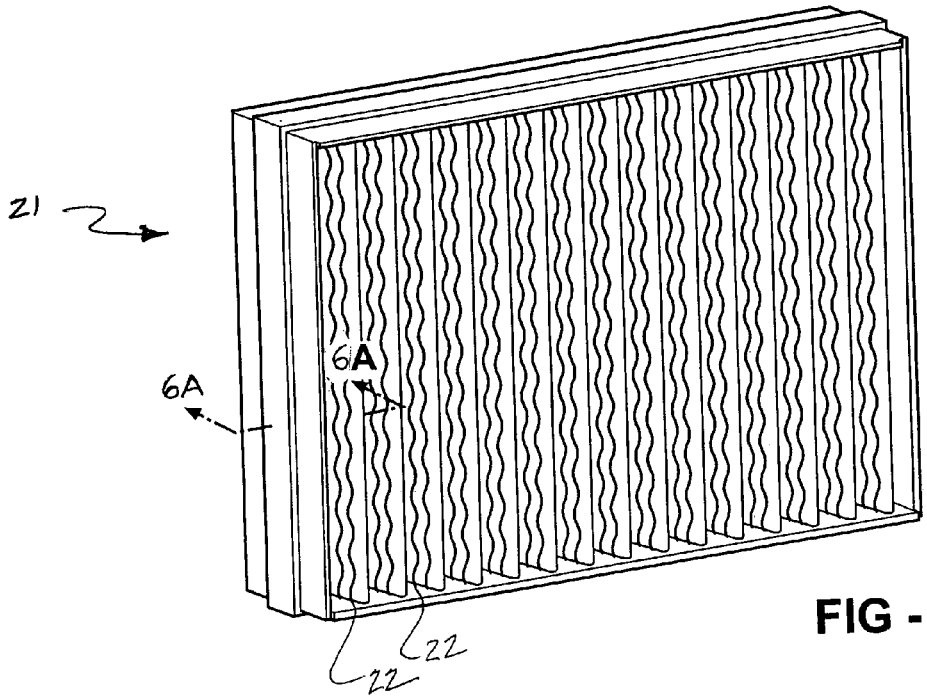
FIG. 6 is a perspective view of a filter for use in the portable air filtration system, wherein the filter includes the filter media and the conductive coating in a continuous pattern that is a parallel pattern of the conductive coating.
Figure 7:
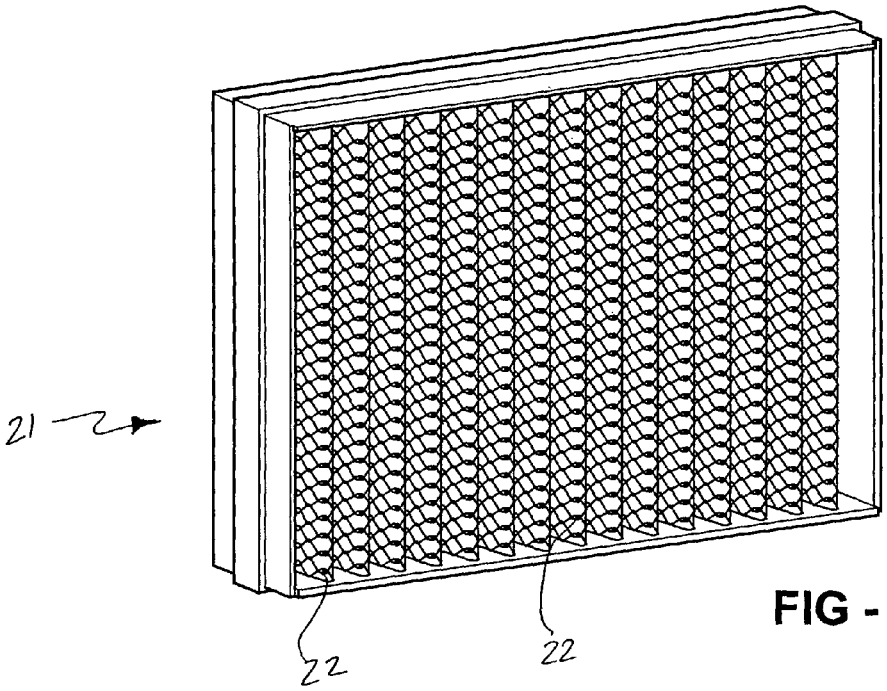
FIG. 7 is a perspective view of a filter for use in the portable air filtration system, wherein the filter includes the filter media and the conductive coating in a continuous pattern that is a web pattern of the conductive coating.

Preferably, the conductive coating 22 is selected from the group consisting of conductive paint, conductive ink, conductive adhesive, and combinations thereof. Also, the conductive coating 22, which essentially functions as an electrode, is preferably applied to the upstream side 50 of the filter media 20 via lamination, pressing, spreading, rolling, spraying, or other application techniques known to those skilled in the art. FIGS. 5–7 all disclose a pleated filter media and FIG. 8 discloses a non-woven, cellular filter media, specifically a honeycomb filter media 25. FIGS. 9 through 10A are described additionally below. In FIGS. 5-7, the conductive coating 22 is applied to the upstream side 50 of the filter media 20 in a continuous pattern of the conductive coating 22. More specifically, in FIG. 5, the conductive coating 22 has been applied in a continuous pattern that is a perpendicular pattern of the conductive coating 22. In FIG. 6, the conductive coating 22 has been applied in a continuous pattern that is a parallel pattern of the conductive coating 22 and, in FIG. 7, the conductive coating 22 has been applied in a continuous pattern that is a web pattern of the conductive coating 22. The determination of perpendicular and parallel for the continuous pattern of the conductive coating 22 is to be made relative to an axis that extends from top to bottom of the pleats, as the filter 21 is oriented in FIGS. 5 and 6.

Figure 6A:
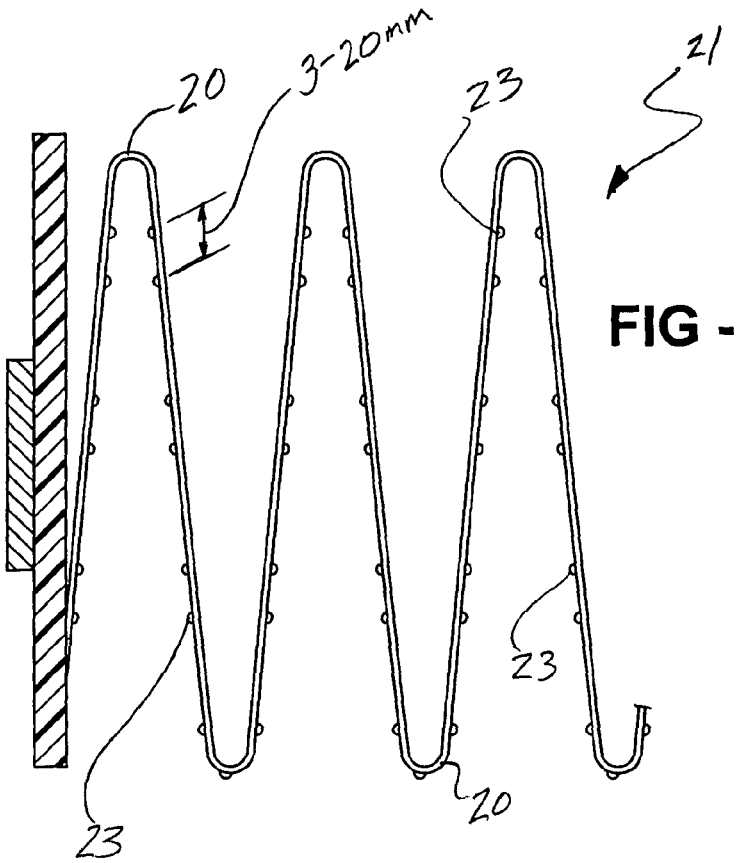
FIG. 6A is a view taken along the line 6A—6A in FIG. 6 illustrating strands of the conductive coating with each of the strands being spaced from 3 to 20 millimeters from an adjacent strand.

In FIG. 6A, which is not to scale, the continuous pattern of the conductive coating 22 includes a plurality of strands 23 of the conductive coating 22 with each of said strands 23 being spaced from 3 to 20 millimeters from an adjacent strand 23. If the strands 23 of the conductive coating 22 are too close together, i.e., less than 3 millimeters, then the efficiency of the filter media 20 is effected and if the strands 23 of the conductive coating 22 are too far apart, i.e., greater than 20 millimeters, then the conductive coating 22 itself cannot effectively function as a ground electrode, which is described below.

In FIG. 8A, the honeycomb filter media 25 includes a plurality of substantially hexagonal edges 27 defining individual cells 29, i.e., filtration apertures, and, in this Figure, the conductive coating 22 has been applied to the substantially hexagonal edges 27 at the upstream side 50 of the honeycomb filter media 25. For the honeycomb filter media 25, it is preferred that the conductive coating 22 is applied in a manner similar to the application of an ink, or other coating, to a printing press, using such tools as a roller and platen. In this case, the conductive coating 22 is rolled onto the edges 27 and its viscosity and other properties are controlled so that the conductive coating 22 does not close the individual cells 29, i.e., the filtration apertures.

Referring to the embodiment of FIGS. 9 and 9A, the filter 21 includes corrugated filter material 31 that is interleaved between flat sheets 33 that extend in a first orientation within the filter 21. In the enlarged view of FIG. 9A, the conductive coating 22 is applied to edges 35 at the upstream side 50 of the filter 21. Referring to the embodiment of FIGS. 10 and 10A, the corrugated filter material 31 and the flat sheets 33 extend in a second orientation that is different from the first orientation. In this particular embodiment, the conductive coating 22 is also applied to the edges 35 at the upstream side of the filter 21. In the embodiments of FIGS. 9 through 10A, the filtration apertures 29 are defined within the corrugated filter material 31 and between the corrugated filter material 31 and the flat sheets 33. Finally, although the conductive coating 22 is not specifically numbered in FIGS. 8A, 9A, and 10, the conductive coating 22 is represented by the dotted shadow markings in these Figures.

The electric field has a distance D, defined between the ionizing mechanism 18 and the conductive coating 22, that has been optimized to control an ionization current applied to the particles and to prevent ozone generation, which is an additional deficiency associated with the air filtration systems of the prior art. The distance D has been optimized to range from 35 to 60, preferably from 40 to 50, mm.

As disclosed schematically in FIG. 4, as a result of the conductive coating 22, the upstream side 50 of the filter media 20 is electrically-connected to ground 54. That is, the filter media 20 is electrically-connected to ground 54 through the conductive coating 22 for dissipating, i.e., bleeding, the negative charge of the particles that become entrapped within the filter media 20. For the negative charge of the particles entrapped within the filter media 20 to dissipate to ground 54 through the conductive coating 22, it is important that the filter media 20 be slightly conductive. That is, although the filter media 20 is 'relatively' dielectric and is, therefore, a poor conductor as compared to the conductivity of the conductive coating 22, the filter media 20 still must possess some degree of conductivity for the charge to dissipate to ground 54 through the conductive coating 22.

With the conductive coating 22 applied to the upstream side 50 of the filter media 20 and with the conductive coating 22 electrically-connected to the ground 54, the conductive coating 22 is able to perform two functions. First, the conductive coating 22 of the subject invention provides a plane for establishing the electric field with the ionizing mechanism 18, which is normally the function of a discrete control electrode that is separate from a ground electrode. Secondly, the conductive coating 22 of the subject invention provides a ground 54 for dissipating charges present in the filter media 20, which is normally the function of a discrete ground electrode that is separate from a control electrode. Because the conductive coating 22 of the subject invention integrates the function of the two separate electrodes present in the prior art, the filtration system 10 of the subject invention has simplified componentry. Application of the conductive coating 22 to the filter media 20, rather than using any ground grid, is ideal because the conductive coating 22 enables maximization of the efficiency of the filter because, unlike a grid, the conductive coating 22 does not physically obstruct any filtration apertures 29 in the filter media 20.

The invention has been described in an illustrative manner, and it is to be understood that the terminology that has been used is intended to be in the nature of words of description rather than of limitation. Obviously, many modifications and variations of the present invention are possible in light of the above teachings. Therefore, it is to be understood that within the scope of the appended claims, the invention may be practiced otherwise than as specifically described.

What is claimed is:

1. A portable air filtration system for filtering air, said filtration system comprising:

a filter housing including an air inlet and an air outlet and defining a filtration chamber between said air inlet and said air outlet;

an intake fan disposed within said filter housing for moving the air through said filtration chamber by drawing the air in through said air inlet and dispelling the air out through said air outlet;

an ionizing mechanism disposed between said intake fan and said air outlet for ionizing particles within the air to a negative charge;

a filter media having an upstream side facing said air inlet and a downstream side facing said air outlet wherein said filter media is disposed between said ionizing mechanism and said air outlet for entrapping the particles between said upstream side and said downstream side;

a conductive coating applied to said upstream side of said filter media to establish an electric field between said ionizing mechanism and said conductive coating, wherein said conductive coating is electrically-connected to ground and to said filter media such that said upstream side of said filter media is electrically-connected to ground through said conductive coating for dissipating the negative charge of the particles entrapped within said filter media.

2. An air filtration system as set forth in claim 1 wherein said filter media is further defined as an electret filter media.

3. An air filtration system as set forth in claim 1 wherein said filter media is further defined as a non-woven filter media.

4. An air filtration system as set forth in claim 3 wherein said non-woven filter media is further defined as a honeycomb filter media having a plurality of substantially hexagonal edges defining individual cells.

5. An air filtration system as set forth in claim 4 wherein said conductive coating is applied to said substantially hexagonal edges at said upstream side of said honeycomb filter media.

6. An air filtration system as set forth in claim 1 wherein said filter media is pleated.

7. An air filtration system as set forth in claim 1 wherein said filter media is non-pleated.

8. An air filtration system as set forth in claim 1 wherein said conductive coating is selected from the group consisting of conductive paint, conductive ink, conductive adhesive, and combinations thereof.

9. An air filtration system as set forth in claim 1 wherein said conductive coating is applied to said upstream side of said filter media in a continuous pattern of said conductive coating.

10. An air filtration system as set forth in claim 9 wherein said continuous pattern of said conductive coating is further defined as a parallel pattern of said conductive coating.

11. An air filtration system as set forth in claim 9 wherein said continuous is pattern of said conductive coating is further defined as a perpendicular pattern of said conductive coating.

12. An air filtration system as set forth in claim 9 wherein said continuous pattern of said conductive coating is further defined as a web pattern of said conductive coating.

13. An air filtration system as set forth in claim 1 wherein said conductive coating is applied to said upstream side of said filter media via lamination.

14. An air filtration system as set forth in claim 1 wherein said conductive coating is applied to said upstream side of said filter media via rolling.

15. An air filtration system as set forth in claim 1 wherein said conductive coating is applied to said upstream side of said filter media via spraying.

16. An air filtration system as set forth in claim 1 wherein said filter media comprises corrugated filter material interleaved between flat sheets.

17. A filter for use in an air filtration system to filter particles in air, said filter comprising:

a filter media for entrapping the particles in the air; and a conductive coating applied to said filter media in a continuous pattern of said conductive coating for dissipating a charge of the particles entrapped within said filter media, wherein said continuous pattern of said conductive coating includes a plurality of strands of said conductive coating with each of said strands being spaced from 3 to 20 millimeters from an adjacent strand.

18. A filter as set forth in claim 17 wherein said filter media is further defined as an electret filter media.

19. A filter as set forth in claim 17 wherein said filter media is further defined as a non-woven filter media.

20. A filter as set forth in claim 19 wherein said non-woven filter media is further defined as a honeycomb filter media having a plurality of substantially hexagonal edges defining individual cells.

21. A filter as set forth in claim 20 wherein said conductive coating is applied to said substantially hexagonal edges.

22. A filter as set forth in claim 17 wherein said filter media is pleated.

23. A filter as set forth in claim 17 wherein said filter media is non-pleated.

24. A filter as set forth in claim 17 wherein said conductive coating is selected from the group consisting of conductive paint, conductive ink, conductive adhesive, and combinations thereof.

25. A filter as set forth in claim 17 wherein said continuous pattern of said conductive coating is further defined as a parallel pattern of said conductive coating.

26. A filter as set forth in claim 17 wherein said continuous pattern of said conductive coating is further defined as a perpendicular pattern of said conductive coating.

27. A filter as set forth in claim 17 wherein said continuous pattern of said conductive coating is further defined as a web pattern of said conductive coating.

28. A filter as set forth in claim 17 wherein said conductive coating is applied to said filter media via lamination.

29. A filter as set forth in claim 17 wherein said conductive coating is applied to said filter media via rolling.

30. A filter as set forth in claim 17 wherein said conductive coating is applied to said filter media via spraying.

31. A filter as set forth in claim 17 wherein said filter media comprises corrugated filter material interleaved between flat sheets.

* * * * *